US007409941B2

(12) United States Patent
Spath et al.

(10) Patent No.: US 7,409,941 B2
(45) **Date of Patent: *Aug. 12, 2008**

(54) VALVE-DEACTIVATING HYDRAULIC LIFTER HAVING A VENTED INTERNAL LOST MOTION SPRING

(75) Inventors: Mark J. Spath, Spencerport, NY (US); Michael E. McCarroll, Henrietta, NY (US)

(73) Assignee: Delphi Technologies, Inc., Troy, MI (US)

( * ) Notice: Subject to any disclaimer, the term of this patent is extended or adjusted under 35 U.S.C. 154(b) by 212 days.

This patent is subject to a terminal disclaimer.

(21) Appl. No.: 11/401,740

(22) Filed: Apr. 11, 2006

(65) Prior Publication Data

US 2006/0225683 A1 Oct. 12, 2006

Related U.S. Application Data

(60) Provisional application No. 60/670,360, filed on Apr. 12, 2005, provisional application No. 60/681,623, filed on May 17, 2005.

(51) Int. Cl.
*F01L 1/14* (2006.01)

(52) U.S. Cl. ..... 123/90.59; 123/90.57; 123/90.55; 123/90.52

(58) Field of Classification Search ..... 123/90.59, 123/90.57

See application file for complete search history.

(56) References Cited

U.S. PATENT DOCUMENTS 6,196,175 B1 * 3/2001 Church ..... 123/90.16
6,321,704 B1 11/2001 Church et al.
6,497,207 B2 12/2002 Spath et al.
7,246,585 B2 * 7/2007 Spath et al. ..... 123/90.48

* cited by examiner

*Primary Examiner*—Thomas Denion
*Assistant Examiner*—Kyle M Riddle
(74) *Attorney, Agent, or Firm*—Michael D. Smith

(57) ABSTRACT

A deactivating hydraulic valve mechanism includes a hydraulic element assembly disposed within cup within a pin housing slidably disposed within a bore in a body. A transverse bore in the pin housing contains selectively-retractable locking pins that engage a locking feature in the body to selectively lock together the body and the pin housing. A lost motion spring is disposed in a vented annular chamber between the body and the pin housing. An oil passage from an engine gallery to the hydraulic element assembly includes an axial component formed in the cup and bypasses the lost motion chamber. A ring holds the lifter assembly together and also sets mechanical lash. The ring may combine a standard-thickness ring and a shim selected to provided a predetermined amount of mechanical lash in the assembled mechanism to ensure facile engagement and disengagement of the locking pins in the body.

15 Claims, 5 Drawing Sheets

VALVE-DEACTIVATING HYDRAULIC LIFTER HAVING A VENTED INTERNAL LOST MOTION SPRING

This application claims priority from Provisional U.S. Patent Application Ser. No. 60/670,360, filed Apr. 12, 2005 and from Provisional U.S. Patent Application Ser. No. 60/681,623, filed May 17, 2005.

TECHNICAL FIELD

The present invention relates to hydraulic valve mechanisms for activating valves in response to rotation of a camshaft in an internal combustion engine; more particularly, to such mechanisms having a locking mechanism for selectively engaging and disengaging such activation; and most particularly, to such a deactivating hydraulic valve mechanism having a vented internal lost motion spring and oil supply to the hydraulic element assembly that bypasses the lost motion spring chamber to minimize oil pumping by the mechanism while in deactivation mode.

BACKGROUND OF THE INVENTION

It is well known that overall fuel efficiency in a multiple-cylinder internal combustion engine can be increased by selective deactivation of one or more of the engine valves, especially the intake valves, under certain engine load conditions. For a cam-in-block pushrod engine, a known approach to providing selective deactivation is to equip the hydraulic lifters for those valves with a locking mechanism whereby the lifters may be rendered incapable of transferring the cyclic motion of engine cams into reciprocal motion of the associated pushrods. Typically, a deactivating hydraulic valve lifter (DHVL) includes, in addition to the conventional hydraulic lash compensation element, an outer body and a concentric locking pin housing disposed inside the outer body. The inner locking pin housing and outer body are mechanically connected to the pushrod and to the cam lobe, respectively, and may be selectively latched and unlatched hydromechanically to each other, typically by the selective engagement of one or more locking pins by pressurized engine oil.

U.S. Pat. No. 6,497,207 discloses such a DHVL wherein a lost motion coil spring is disposed between the lifter body and a tower extension of the inner pin housing. The tower extension is hollow and open at the outer end to admit an engine pushrod. This arrangement is functionally satisfactory for many but not all engine designs. In particular, the tower results in a relatively long overall length of the DHVL and, in order for the pushrod to clear the outer edge of the tower extension, the pushrod must be aligned nearly coaxial with the DHVL. Thus, this arrangement may be incompatible with engines having limited axial space for the added length DHVL, or for engines having relatively large pushrod engagement angles.

It is known in the art to shorten the operative length of a body and locking pin housing assembly by packaging the lost motion (LM) spring between the adjacent walls of the outer lifter body and the inner pin housing, thereby obviating the need for a tower and its concomitant length. U.S. Pat. No. 6,321,704 B1 ("the '704 patent") discloses a hydraulic lash adjuster for valve deactivation in a cam-in-head roller finger follower engine having an outer body and an inner locking pin housing wherein the LM spring is disposed in an annular spring chamber between the walls of the body and locking pin housing.

A significant shortcoming of disposing the LM spring between the outer body and inner locking pin housing, as shown in the '704 patent, is that oil being supplied to the hydraulic element assembly (HEA) must pass through the LM spring chamber. Thus the chamber is always filled with oil, which must be pumped out of the chamber with every stroke of the lifter body in deactivation mode. Pumping oil reduces engine efficiency, as during at least part of the pumping stroke the oil pressure generated in the LM chamber opposes the engine's own oil pressure, and may cause valve train stability issues, wear, and noise due to induced air bubbles or cavitations. Still further, juxtaposition of the oil passages in the outer body and inner locking pin housing under certain lash conditions can allow for a low oil drawdown (drainage) level in the lash adjuster reservoir during engine shutdown, resulting in significant engine noise at restart.

In addition, the disclosure fails to account for mechanical lash in the deactivation mechanism resulting from inherent manufacturing variability in the deactivation components. The entire assembly is held together by a standard stop clip which is full-fitting in a groove in the outer body member. Thus, the amount of lash between the latching member and the latching surface after assembly, resulting from manufacturing variability in the components, cannot be compensated or adjusted in individual lifter or lash adjuster assemblies.

What is needed in the art is a deactivation lifter or lash adjuster assembly wherein the LM spring chamber is not in communication with the engine oil being supplied to the HEA.

What is further needed in the art is a deactivation lifter or deactivation lash adjuster assembly wherein mechanical lash within the lifter or lash adjuster may be readily set by appropriate shimming during assembly.

It is a principal object of the present invention to provide improved valve deactivation without pumping of deactivation oil in an LM spring chamber in engines requiring short overall length and large pushrod angle capability in a deactivation lifter or deactivation lash adjuster.

SUMMARY OF THE INVENTION

Briefly described, a deactivating hydraulic valve lifter or deactivating hydraulic lash adjuster, hereinafter referred to as a deactivation mechanism or DHVL, in accordance with the invention includes a conventional hydraulic lash adjustment element, also referred to herein as a hydraulic element assembly (HEA), disposed between a plunger and a cup member. The plunger and cup member are, in turn, disposed in a pin housing that is slidably disposed within an axial bore in a body. A transverse bore in the pin housing contains at least one locking pin that engages a locking feature such as a circumferential groove including a locking surface in the body whereby the body and the pin housing are locked together for mutual actuation by rotary motion of the cam lobe to produce reciprocal motion of an engine pushrod disposed against the hydraulic lash adjustment element.

A lost motion coil spring is disposed in an annular chamber formed within the envelope of the deactivation mechanism between the body and the pin housing. A vent of the annular chamber permits ready discharge of any accumulated oil from the chamber on the first lost-motion stroke of the body and thereafter.

An oil passage is provided from an engine gallery to the hydraulic element assembly, at the interface between the cup member and pin housing thereby bypassing the lost motion annular chamber.

An expansion ring holds the assembly together and also functions to set the mechanical lash in the deactivation mechanism. The ring may be provided as a two-part ring, the first part being a standard-thickness ring and the second part being a shim having a thickness selected to provided a predetermined amount of mechanical lash in the assembled mechanism to ensure facile engagement and disengagement of the locking pins in the body. The ring may also be provided as a one piece ring, its thickness being selected to set mechanical lash.

BRIEF DESCRIPTION OF THE DRAWINGS

These and other features and advantages of the invention will be more fully understood and appreciated from the following description of certain exemplary embodiments of the invention taken together with the accompanying drawings, in which.

DESCRIPTION OF THE PREFERRED EMBODIMENTS

Figure 1:
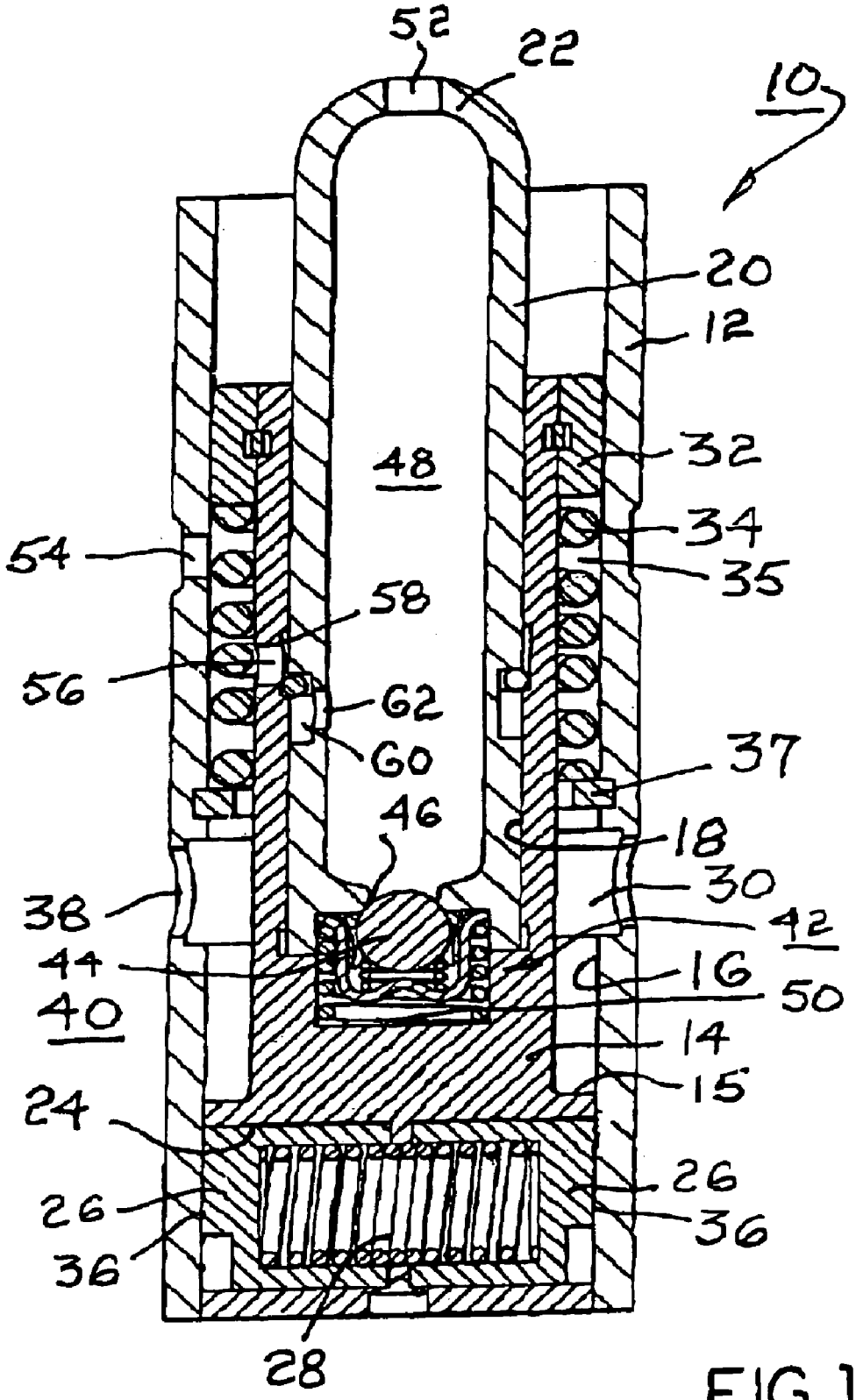
FIG. 1 (PRIOR ART)
FIG. 1 is an elevational cross-sectional view of a deactivating hydraulic lash adjuster for use as a roller finger follower pivot in an overhead cam engine, substantially as disclosed in U.S. Pat. No. 6,321,704 B1.
Figure 2:
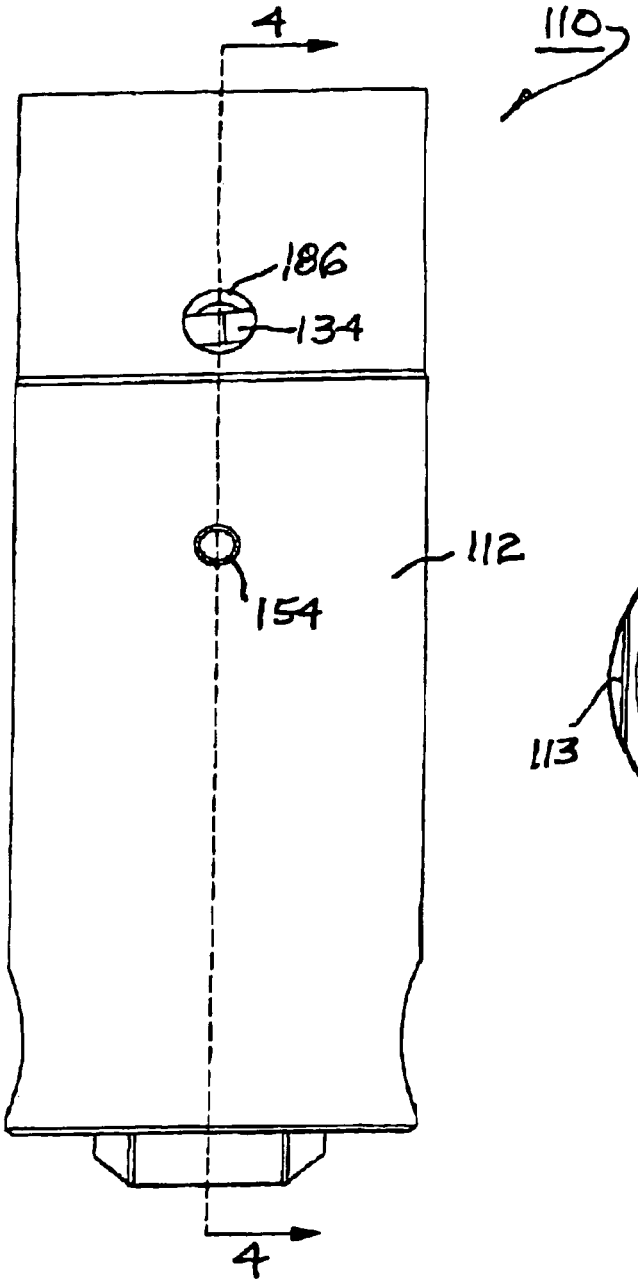
FIG. 2 is an elevational view of a first embodiment of a deactivating hydraulic valve lifter in accordance with the invention for use in a pushrod internal combustion engine.
Figure 3:
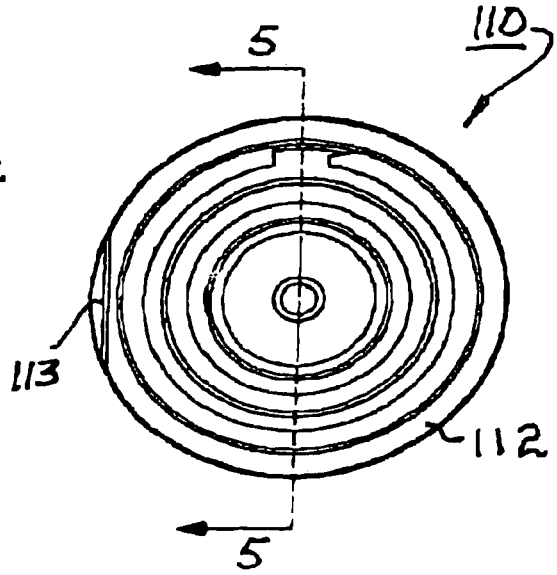
FIG. 3 is a plan view of the lifter shown in FIG. 2, shown rotated 90° counterclockwise.

Referring to FIG. 1, a deactivating hydraulic lash adjuster 10 is substantially as disclosed in U.S. Pat. No. 6,321,704 B1. Lash adjuster 10 has a generally cylindrical adjuster body 12. A pin housing 14 is slidably disposed within a first axial bore 16 in adjuster body 12. Pin housing 14 itself has a second axial bore 18 for slidably receiving a plunger 20 having a domed end 22 for receiving a socket end (not shown) of a roller finger follower in an overhead-cam engine valve train.

Pin housing 14 has a transverse bore 24 slidably receivable of two opposed locking pins 26 separated by a pin-locking spring 28 disposed in compression therebetween. First axial bore 16 in adjuster body 12 is provided with a circumferential groove 30 for receiving the outer ends of locking pins 26, thrust outwards by spring 28 when pins 26 are axially aligned with groove 30. In such configuration, lash adjuster 10 is in valve-activation mode. (As shown in FIG. 1, lash adjuster 10 is in valve-deactivation mode.)

Upper end 32 of pin housing 14 defines a first seat for a loss-of-motion (LM) return spring 34 disposed within an annular spring chamber 35 formed between bore 16 and pin housing 14. LM spring 34 finds a second seat at an annular stop 37 in bore 16.

Groove 30 further defines a reservoir for providing high pressure oil against the outer ends 36 of locking pins 26 to overcome spring 28 and retract the locking pins into bore 24, thereby unlocking the pin housing from the adjuster body to deactivate the adjuster. Groove 30 is in communication via at least one port 38 with an oil gallery (not shown) in an engine 40, which in turn is supplied with high pressure oil by an engine control module (not shown) under predetermined engine parameters in which deactivation of valves is desired.

Plunger 20 includes check valve components 42 lodged at an inner end thereof. The arrangement of the components and operation of feature 42 has been well known in the prior art for many years. Check valve components 42 include a spring loaded check ball 44 lodged against a seat 46 formed in plunger 20 separating a low-pressure oil reservoir 48 from a high-pressure chamber 50. Oil is supplied to annular chamber 35 from an engine oil gallery (not shown) via port 54 in adjuster body 12. Chamber 35 is also in communication with reservoir 48 via port 56 and annular groove 58 in pin housing 14 and annular groove 60 and port 62 in plunger 20. Oil may be supplied from reservoir 48 to an associated roller finger follower (not shown) via port 52 in the outer end 22 of plunger 20.

In operation, lash adjuster 10 is disposed in a bore in engine 40 such that housing 12 remains stationary. When the associated cam and rocker arm (not shown) exert force on plunger end 22, in lost motion (valve-deactivation) mode, plunger 20 and pin housing 14 are forced into adjuster body 12 in a lost-motion stroke, compressing LM spring 34. A serious operational problem exists with the arrangement shown for lash adjuster 10. As spring 34 is compressed and the volume of chamber 35 is diminished, oil within chamber 35 must be pumped out, to the detriment of the mechanism and engine performance as described hereinabove.

A DHVL (not shown) having an internal LM spring arrangement similar to lash adjuster 10 is known in the art. Such a lifter performs for a pushrod engine the same LM function as does lash adjuster 10 for an overhead-cam engine. In operation during valve-deactivation mode, of course, it is the plunger and pin housing that remain stationary against a valve pushrod while the lifter body reciprocates past the pin housing, compressing the LM spring and diminishing the volume of the annular spring chamber. Such a prior art DHVL suffers from the same shortcomings as lash adjuster 10, the pumping of oil in the LM chamber during operation in deactivation mode.

What is needed in the art, for deactivating hydraulic lash adjusters as well as for DHVLs, is a mechanism whereby oil is supplied to a central reservoir in the lifter or adjuster from an engine oil gallery without passing through an internal lost-motion chamber.

Referring now to FIGS. 2 through 5, a first embodiment 110 of an improved DHVL in accordance with the invention comprises many components identical or analogous to those described hereinabove for lash adjuster 10, which components bear the same identification numbers plus 100. Components which are different or significantly modified bear new numbers in the 100 and 200 series.

DHVL 110 has a generally cylindrical body 112. A pin housing 114 is slidably disposed within a stepped first axial bore 116 in body 112. Pin housing 114 itself has a second axial bore 118 for receiving a cup member 119 which in turn slidably receives a plunger 120 supporting a pushrod seat 122 for receiving a ball end 123 of a pushrod in an engine valve train.

Figure 4:
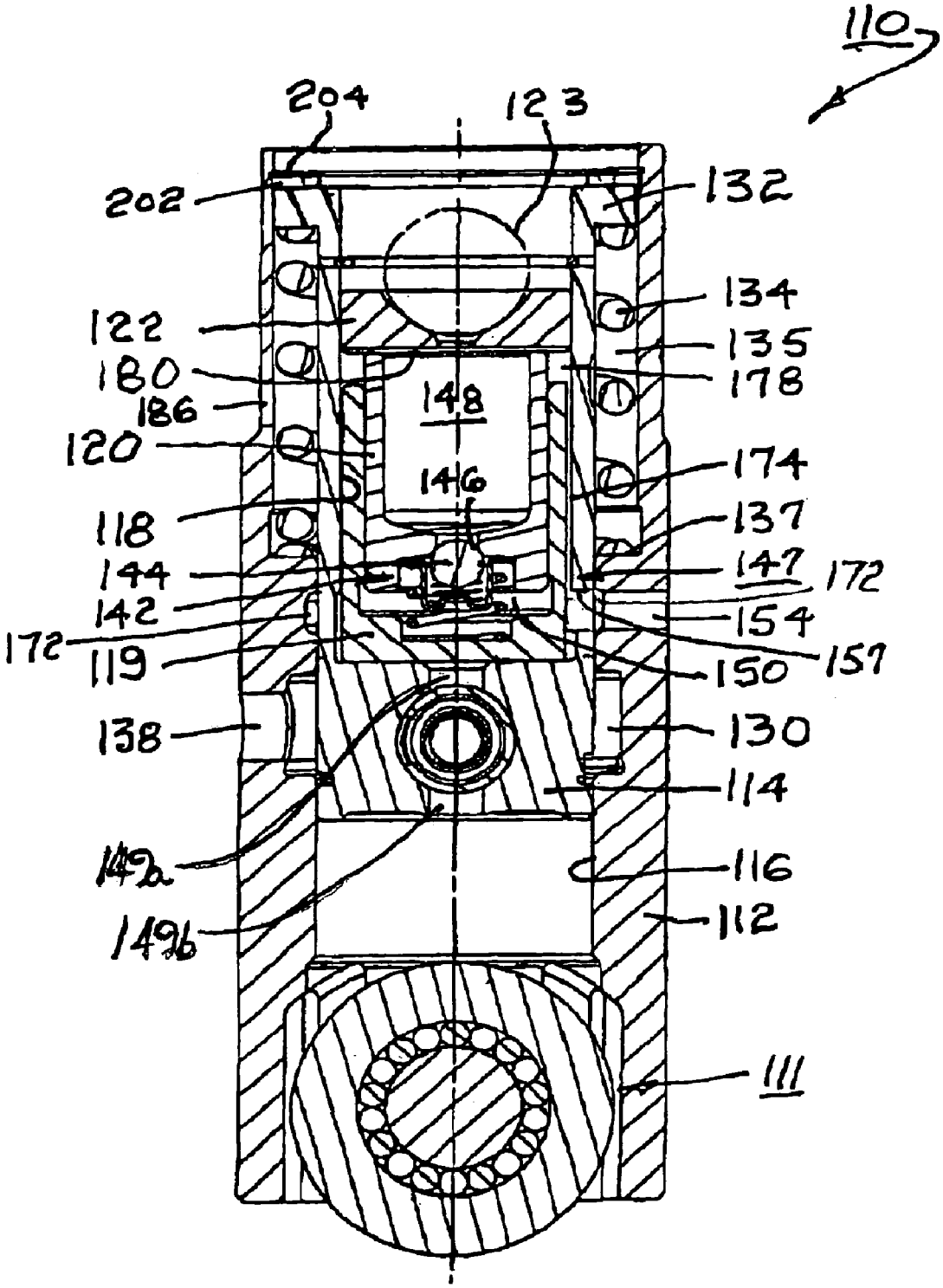
FIG. 4 is a first elevational cross-sectional view taken along line 4-4 in FIG. 2.
Figure 5:
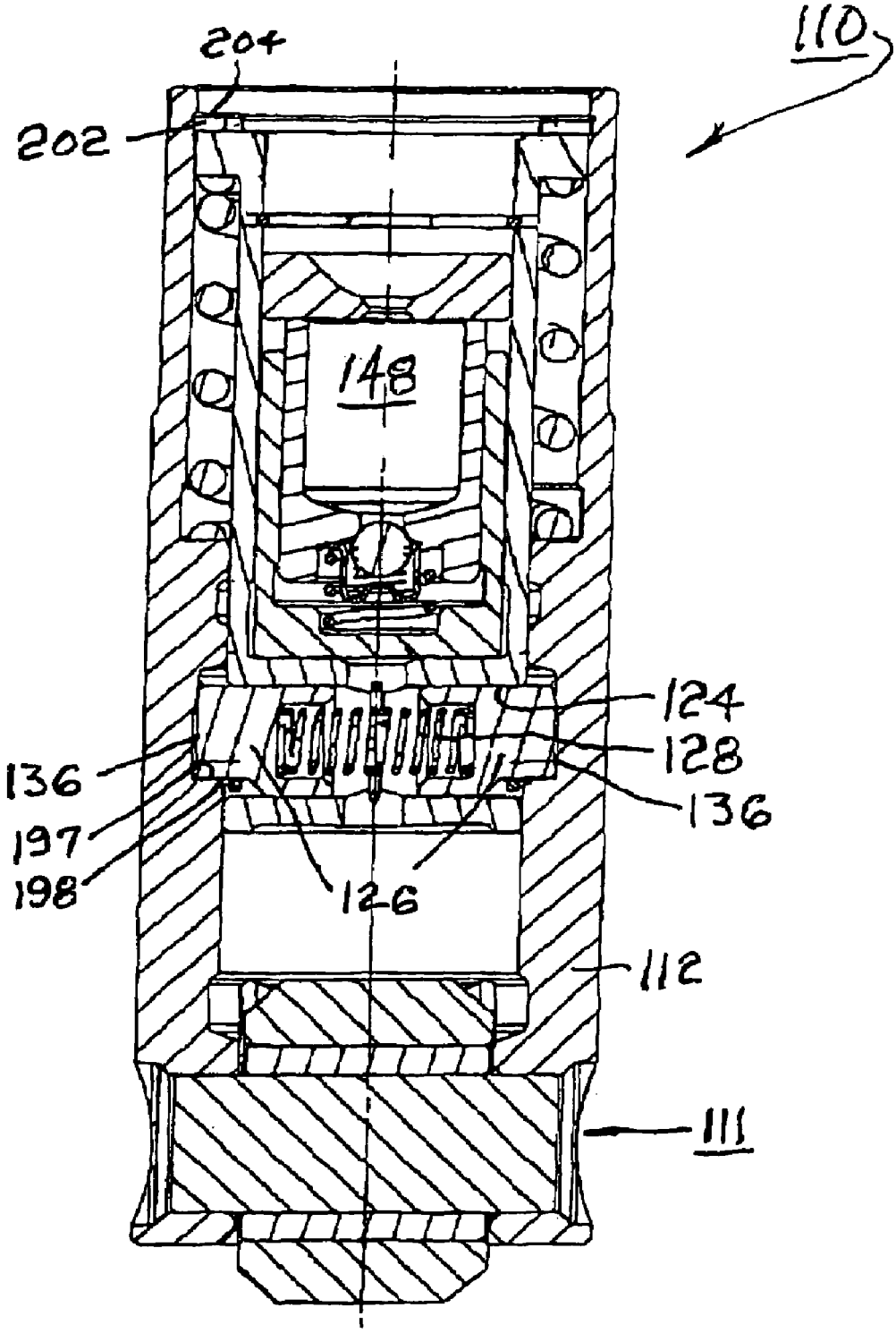
FIG. 5 is a second elevational cross-sectional view taken along line 5-5 in FIG. 3, this view being orthogonal to the view shown in FIG. 4.

Pin housing 114 has a transverse bore 124 slidably receivable of two opposed locking pins 126 separated by a pin-locking spring 128 disposed in compression therebetween. First axial bore 116 in body 112 is provided with a locking feature such as, for example, circumferential groove 130 for receiving the outer ends of locking pins 126, thrust outwards by spring 128 when pins 126 are axially aligned with groove 130. In such configuration, DHVL 110 is in valve-activation mode. (As shown in FIGS. 4 and 5, DHVL 110 is in valve-activation mode.)

Upper end 132 of pin housing 114 defines a first seat for a loss-of-motion (LM) return spring 134 disposed within an annular spring chamber 135 formed between stepped bore 116 and pin housing 114. LM spring 134 finds a second seat at annular step 137 in bore 116.

Groove 130 further defines a reservoir for providing high pressure oil against the outer ends 136 of locking pins 126 to overcome spring 128 and retract the locking pins into bore 124, thereby unlocking the pin housing from the lifter body to deactivate the lifter. Groove 130 is in communication via at least one port 138 with a first oil gallery 131 (FIGS. 6 and 7) in an engine 140, which in turn is supplied with high pressure oil by an engine control module (not shown) under predetermined engine parameters in which deactivation of valves is desired.

Plunger 120 includes check valve components 142 lodged at an inner end thereof which, like check valve components 42 of lash adjuster 10, has been well known in the prior art for many years. Components 142 comprises a spring loaded check ball 144 lodged against a seat 146 formed in plunger 120 separating a low-pressure oil reservoir 148 from a high-pressure chamber 150.

DHVL 110 includes a conventional cam follower roller assembly 111 that is well known in the prior art and need not be further elaborated here. Roller assembly 111 is recited solely for completion of disclosure and forms no part of the novelty of the present invention.

The oil passage 147 by which oil is supplied to reservoir 148 is an improved and distinguishing feature of DHVL 110 over lash adjuster 10. Oil is supplied to reservoir 148 from a non-switched second engine oil gallery 170 (FIGS. 6 and 7) via port 154 in lifter body 12 circumventing LM spring chamber 135, as follows:

Oil from second gallery 170 is fed through body port 154, thence through an annular oil distribution groove 172 formed in bore 116, thence through port 157 in pin housing 114, thence through an axially-extending passage 174, such as a groove, formed in the outer surface of cup member 119 and leading around LM spring chamber 135, thence through an adjacent headspace 178 beyond the end of cup member 119, and thence through a transverse groove 180 formed in the underside of pushrod seat 122 and into reservoir 148. Note that this oil path provides a high drainback residual oil level in reservoir 148 compared to the level in prior art plunger 20 which is fixed by the level of port 62. Note also that any oil from oil passage 147 that may undesirably be trapped in an area beneath the cup member 119 is vented away through pin housing 114 to the outside of the DHVL via vent passages 149 a and b formed in the bottom of pin housing 114.

Cup member 119 is a novel element over a prior art valve-deactivation lifter or lash adjuster, and is necessitated as follows. Note that reservoir 148 is contained fully within the axial extent of LM chamber 135 and is therefore not directly accessible in a radial direction for an oil supply passage except undesirably through chamber 135 as disclosed in the prior art shown in FIG. 1. Ergo, supply port 154 must be located beyond the axial limit of chamber 135; however, inspection shows that a port at that axial location, absent intervening cup member 119, intersects high pressure chamber 150, which is clearly infeasible. Thus, intervening cup member 119 is necessitated. An additional benefit of cup member 119 is that it provides a ready bed for axial passage 174 and thereby provides means for conveying oil desirably to the upper end of plunger 120 for entry into reservoir 148, resulting in a maximally high drainback level in reservoir 148.

Passage 174 is shown in FIG. 4 as being an axial groove formed in the outer surface of cup member 119. Of course, passage 174 may be formed alternately as an axial groove on the inside surface of pin housing 114.

Further, transverse groove 180 is shown as being formed in pushrod seat 122. Of course, alternatively oil may be supplied from headspace 178 to reservoir 148 via other means which will occur to those of ordinary skill in the art, for example, a notch in the end of plunger 120 mating with seat 122 or a bore through plunger 120 near seat 122. All such alternative passage means are fully contemplated by the invention.

Figure 7:
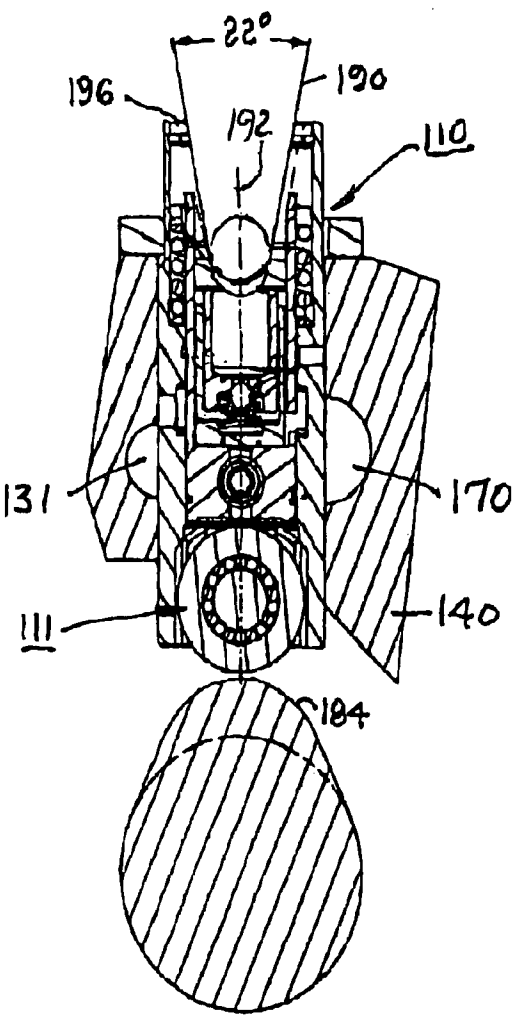
FIG. 7 is a view like that shown in FIG. 6, but with the lifter in deactivation (lost motion) mode and the lifter being on the eccentric portion of the cam lobe, showing that the lifter body stays outside of the desired cone of activity for an associated pushrod.
Figure 6:
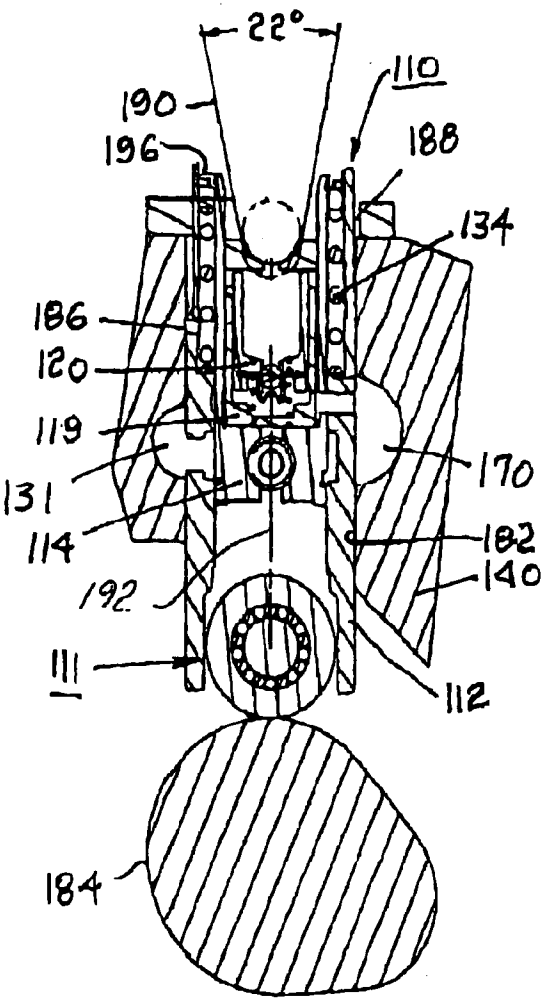
FIG. 6 is a cross-sectional elevational view showing the lifter shown in FIG. 4 disposed in an engine block adjacent a cam, the lifter being on the base circle portion of the cam lobe.

Referring now to FIGS. 6 and 7, in operation, DHVL 110 is disposed in a bore 182 in engine 140 such that body 112 is slidably disposed therein. When the associated cam 184 exerts valve-opening force on roller follower assembly 111 in lost motion (valve-deactivation) mode (FIG. 7), body 112 is forced past plunger 120, cup member 119, and pin housing 114 (which are prevented from moving by a pushrod and associated valve spring, not shown) in a lost-motion stroke, compressing LM spring 134. As spring 134 is compressed and the volume of chamber 135 is diminished, there is no oil systematically provided within chamber 135 to be pumped out, as in the prior art. Further, a vent port 186 is provided in lifter body 112 which overlaps an axial passage 188 formed in engine 140 to permit venting and refilling of chamber 135 with air as the lifter body reciprocates past the stationary pin housing and engine, thereby minimizing the non-productive work required by HDVL 110.

An important feature of an DHVL in accordance with the invention is that a wide range of pushrod angles may be accommodated in a relatively short assembly. Cone 190 represents the cone of operation available for pushrods, which in the example shown is a full cone angle of 22°, accommodating pushrod angles from the lifter axis 192 of up to 11°. At the extreme of the lost motion stroke (FIG. 7), the outer end 196 of body 112 does not extend into cone 190. Another noteworthy feature is that the outer diameter of pushrod seat 122 is larger than the sealing diameter of plunger 120, that is, to some extent, the pushrod seat overhangs the plunger. This feature is important because the pushrod seat is a sealing type relying on the close fit between its outer diameter and the inside diameter of the pin housing to direct oil from passage 147 into reservoir 148. Thus, any wear or deformation of the bottom face of the pushrod seat caused by contacting the plunger will be contained on the bottom face and not be translated to the sealing diameter (outer diameter) of the pushrod seat.

Referring again to FIGS. 4 and 5, it is yet another important feature of a DHVL in accordance with the invention that each DHVL unit as manufactured may be adjusted to provide a desired amount of internal mechanical axial lash to ensure ready locking and unlocking of the latching pins. Such lash is defined as the clearance between locking surface 197 and pin face 198 when the DHVL is assembled and the pins are therefore in locking position. Sufficient clearance is needed to permit the pins to lock and unlock easily and reliably, but additional clearance creates clatter and accelerated wear in operation of the DHVL. Because of inherent variability in components of a DHVL as manufactured, variations in lash must occur in the mechanism shown in FIG. 1 wherein a single retaining ring is employed. See, for example, axial stop 37 in lash adjuster 10 which governs the stroke of pin housing 14 by engaging flange 15 when lock pin housing 14 is in its up-most position and thus positioning pins 26 for engagement into bores 30. As can be seen in lash adjuster 10, a change in the thickness of stop 37 has no affect on lash. In contrast, in an assembly in accordance with the invention, groove 130 is formed having a length in the axial direction greater than the axial length of locking pins 126. After assembly of any one DHVL using a standard ring 202 having a thickness intended to yield excessive mechanical lash between the locking surface and locking pin, the resulting lash can be measured directly, and a shim ring 204 of a thickness selected to provide optimum lash may be subsequently installed adjacent to ring 202. Alternately, the resulting accumulated lash of a particular DHVL may be measured and a one piece ring of a desired thickness may be installed to achieve the desired mechanical lash.

Referring again to FIG. 3, body 112 preferably is provided with a single off-center flat 113 for antirotation and error-proofing of DHVL installation into engine 140 to ensure that the oil ports are correctly aligned with their respective feed galleries. Preferably, a guide plate (not shown) is employed during installation of a DHVL into an engine block. The guide plate includes asymmetric features such as bolt holes or a mating recess in the engine block such that the guide plate cannot be installed over the DHVL, or mated to the engine, unless the DHVL is properly oriented to the engine. In a V-6 application, typically all lifters in one engine bank are DHVLs.

While the text of the specification relates this invention to a deactivating hydraulic valve lifter (DHVL), it is understood that the invention is equally applicable to other valve deactivating devices such as deactivating roller hydraulic valve lifters (DRHVL) as shown in FIGS. 2-7 and to deactivating hydraulic lash adjusters (DHLA) as shown in FIG. 1.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A deactivating hydraulic valve apparatus for selectively coupling the rotary motion of a cam to the reciprocal motion of a combustion valve in an internal combustion engine, comprising:

a) a body having a first axial bore and having a locking feature communicable with a first oil gallery in said engine;

b) a pin housing slidably disposed in said first axial bore and having a second axial bore and having a transverse bore;

c) a cup member disposed within said second axial bore;

d) a plunger slidably disposed in said cup member and having a reservoir therein;

e) a check valve disposed in said cup member communicating with said reservoir to define a low pressure chamber in said reservoir and a high pressure chamber between said plunger and said cup member;

f) at least one locking pin slidably disposed in said transverse bore for selectively engaging said locking feature in said body in response to oil supplied from said first oil gallery;

g) a lost motion spring compressively disposed in a chamber between said body and said pin housing for urging relative motion between said body and said pin housing; and h) an oil passage communicable with a second oil gallery in said engine and extending between an outer surface of said body and said reservoir, wherein said oil passage bypasses said chamber.

2. An apparatus in accordance with claim 1 further comprising a shim disposed between said body and said pin housing for setting mechanical lash in said apparatus.

3. An apparatus in accordance with claim 2 wherein said shim includes a first ring of a thickness and a second ring adjacent said first ring, said second ring defining a thickness selected to provide said mechanical lash to a predetermined value.

4. An apparatus in accordance with claim 1, wherein said apparatus is a deactivating hydraulic valve lifter for engaging a pushrod in said engine.

5. An apparatus in accordance with claim 4 further comprising a roller disposed on said body.

6. An apparatus in accordance with claim 1 wherein said apparatus is a deactivating hydraulic lash adjuster.

7. An apparatus in accordance with claim 1 wherein said oil passage includes a passage having an axial vector component formed in said cup bushing.

8. An apparatus in accordance with claim 7 wherein said passage includes a groove formed in an outer surface of said cup bushing.

9. An apparatus in accordance with claim 1 further comprising a pushrod seat disposed at an end of said plunger for closing said reservoir.

10. An apparatus in accordance with claim 9 wherein said plunger has an outer diameter and said pushrod seat has an outer diameter and wherein said seat outer diameter is larger than said plunger outer diameter.

11. An apparatus in accordance with claim 9 wherein said oil passage includes a groove on a surface of said pushrod seat.

12. An engine in accordance with claim 11 wherein said engine is selected from the group consisting of cam-in-block and cam-in-head.

13. An apparatus in accordance with claim 1 further comprising a lost motion spring chamber vent.

14. An apparatus in accordance with claim 1 wherein said pin housing includes an oil vent passage for venting oil from beneath said cup member to outside said deactivating hydraulic valve apparatus.

15. An internal combustion engine having a valve train comprising a deactivating hydraulic valve apparatus for selectively coupling the rotary motion of a cam to the reciprocal motion of a combustion valve in said engine, wherein said apparatus includes a body having a first axial bore and having a locking feature communicable with a first oil gallery in said engine, a pin housing slidably disposed in said first axial bore and having a second axial bore and having a transverse bore, a cup member disposed within said second axial bore, a plunger slidably disposed in said cup member and having a reservoir therein, a check valve disposed in said cup member communicating with said reservoir to define a low pressure chamber in said reservoir and a high pressure chamber between said plunger and said cup member, at least one locking pin slidably disposed in said transverse bore for selectively engaging said locking feature in said body in response to oil supplied from said first oil gallery, a lost motion spring compressively disposed in a chamber between said body and said pin housing for urging relative motion between said body and said pin housing, and an oil passage communicable with a second oil gallery in said engine and extending between an outer surface of said body and said reservoir, wherein said oil passage bypasses said chamber.

* * * * *